United States Patent [19]

Vasiliev et al.

[11] 4,441,549

[45] Apr. 10, 1984

[54] HEAT EXCHANGER WITHIN DENSE GRAVITY LAYER

[75] Inventors: Boris P. Vasiliev; Nikolai L. Borisov; Mikhail K. Semenov; Ivan K. Ponomarev; Galina B. Tyryshkina; Igor V. Gorbatenko, all of Belgorod, U.S.S.R.

[73] Assignee: Belgorodsky Zavod Energeticheskogo Mashinostroenia, U.S.S.R.

[21] Appl. No.: 316,124

[22] Filed: Oct. 29, 1981

[51] Int. Cl.[3] ..... F28F 9/22

[52] U.S. Cl. ..... 165/145; 34/20; 34/177; 165/165; 165/159; 165/DIG. 27; 202/228; 202/270

[58] Field of Search ..... 165/165, 81, 83, DIG. 27, 165/145; 34/57 A, 177, 20; 422/223; 202/122, 243, 253, 228, 270

[56] References Cited

U.S. PATENT DOCUMENTS

| | | | |
|---|---|---|---|
| 1,825,498 | 9/1931 | Wogan | 165/165 X |
| 2,468,903 | 5/1949 | Villiger | 165/81 X |
| 2,828,946 | 4/1958 | Smith | 165/83 |
| 2,911,198 | 11/1959 | Karlsson | 34/177 |
| 3,483,920 | 12/1969 | Heyn et al. | 165/165 |

*Primary Examiner*—William R. Cline
*Assistant Examiner*—Theophil W. Streule, Jr.
*Attorney, Agent, or Firm*—Steinberg & Raskin

[57] ABSTRACT

A heat exchanger within a dense gravity layer comprises a vertical cylindrical container with a heating surface built thereinto. The heating surface is formed by a tubular housing containing a plurality of tubes mounted in tiers. A space between the inner surface of the container and the outer surface of the housing is divided by opposite seals into two vertical cavities. These cavities are divided along the height thereof by horizontal baffle members which are arranged in chessboard pattern relative one another to form chambers located along the height in a chessboard pattern, and to accomplish repeated variation of the direction of movement of one of heat carriers.

14 Claims, 4 Drawing Figures

HEAT EXCHANGER WITHIN DENSE GRAVITY LAYER

BACKGROUND OF THE INVENTION

1. Field of the Invention

The present invention relates to the art of energy-technological processing organic solid fuels, and particularly to the design of heat exchangers in which the heat transfer is accomplished from a dense gravity layer of bulk materials.

The invention may prove most advantageous when used in energy-technological lines for the heat treatment of oil shales of fine fractional compositions.

2. Prior Art

Due to the ever increasing fuel consumption, oil in particular, and resulting decrease in resources of quality fuel, more and more attention is paid at present to the utilization of fuels having low heat of combustion.

It is well known that the shortage in valuable fuels can be compensated by means of thermal or energy-technological processing low-quality fuels. Such fuels may be brown coal or oil shales.

It is known from the experience of thermal processing oil shales of fine fractional compositions that in the process of fuel treatment a great amount of ash is continuously emanated. Generally the amount of this ash is about 30 to 40% based on the mass of starting fuel, the initial temperature of said ash being of about 800° C. Naturally, such a temperature potential is to be used, i.e. the heat of ash is to be utilized. However, those skilled in the art of power engineering have been engaged up to now mainly in the problem of heat treating solid fuels. At present, due to the expansion of scale of treating oil shales in particular, the problem of utilization of the heat of ash thereof has arisen.

However, in the practice of energy-technological processing fuels, heat exchangers for the commercial utilization of the heat of fine fractional ash within a dense gravity layer are not known.

The use of conventional heat exchangers to solve this problem is difficult since such heat exchangers are designed as a rule to be utilized with gaseous or liquid heat carriers. The difficulties are caused by a high pressure and temperature of the ash, and by the necessity of the provision of a uniform distribution of the ash flow during its motion within a dense gravity layer. The complexity of utilization of the prior art heat exchangers further consists in that they cannot withstand high pressures and operate in an energy-technological line to accomplish preliminary heating of air which is to be supplied under high pressure directly to the fuel processing apparatus.

Known in the art is a heat exchanger (U.S. Pat. No. 3,483,920), comprising a vertical cylindrical container provided with upper and lower end walls, a heating surface disposed inside the container and formed by a tubular perforated housing opened at the lower end and a plurality of tubes mounted therewithin in tiers, said tubes being so disposed that the tubes of one tier are transverse to those of adjacent tiers, opposite seals mounted between the inner surface of the container and the outer surface of the housing so that they divide the cavity of the container along the whole height thereof into two portions, an inlet for one type of the heat carrier inside the housing, an inlet pipe for the other type of the heat carrier to be supplied into the space provided between the inner surface of the container and the housing, and an outlet pipe for discharging the second type of the heat carrier.

The opposite seals of the housing are formed by W-shaped holders extending along the whole height of the container. The W-shaped holders contact with recesses thereof with the housing edges.

For the purpose of changing the direction of motion of the heat carrier passing through the pipes of the heating surface, the tubes having similar location are connected therebetween by means of elbows.

In principle, the above described heat exchanger may be used for the utilization of the ash heat, though its application in the commercial energy-technological lines faces some difficulties.

Thus, in the above described heat exchanger the heat carrier which can be air, in the process of motion over the heat exchanger and passing through the tubes of the heating surface, flows along the shortest path, i.e. from the inlet to the outlet. Due to such an arrangement, some "shaded" regions or regions located out of the shortest path are formed within the container. The heat exchange in such regions is lowered, thereby decreasing heat removal.

The attempts of elimination of the "shaded" regions by coupling, using elbows, similarly directed tubes lead to other difficulties. Thus, when using a gaseous heat carrier, the diameters of tubes and coupling elbows are to be increased. This results in a drastic increase in the metal content of the structure, requires the solution of a complicated problem of thermal expansions, and finally causes a significant complication of assemblying the heat exchanger. On the other hand, if the velocity of the gaseous heat carrier is increased instead of increasing the diameters of the tubes, such an increase will result in a considerable growth of aerodynamic resistances. This requires additional power expenditures.

Moreover, tightly sealing the housing by the W-shaped holders eliminates the temperature displacements of the housing relative to the container.

SUMMARY OF THE INVENTION

The object of the invention is to provide a heat exchanger within a dense gravity layer, which with the same overall dimensions and practically the same metal content as compared with the prior art devices will allow the efficiency of utilization of the heat of hot ash to be upgraded.

Another object of the invention is to increase reliability of the heat exchanger within a dense gravity layer by providing for free thermal expansions in the vertical direction.

A further object of the invention is to ensure a constant thermal work of the heat exchanger within a dense gravity layer under conditions of significant thermal expansions, and particularly under high average temperature levels.

Still another object of the invention is the provision of a heat exchanger within a dense gravity layer, having improved distribution of the bulk material within the space inside the tubular housing, as compared with the prior art apparatus.

The objects set forth and other objects of the invention are attained by that in a heat exchanger within a dense gravity layer, comprising a vertical cylindrical container provided with upper and lower end walls, a heating surface disposed within the container and is formed by a tubular perforated housing, opened at the lower end, and a plurality of tubes mounted in tiers therewithin, said tubes being so disposed that the tubes of one tier are transverse to those of adjacent tiers, opposite seals mounted between the inner surface of the container and the outer surface of the housing so that they divide the cavity of the container along the whole height thereof into two portions, an inlet for one type of the heat carrier inside the housing, an inlet pipe for an other type of the heat carrier to be supplied into the space between the inner surface of the container and the housing, an outlet pipe for discharging said another type of the heat carrier, and supports, according to the invention said two portions of the container cavity are divided along the height thereof by horizontal baffle members arranged in chessboard pattern relative one another to form chambers located along the height of a chessboard pattern, and to accomplish repeated variation of the direction of movement of said another type of the heat carrier.

Such arrangement of the heat exchanger generally allows an average temperature head between the heat carriers to be increased since the repeated variation of the direction of movement of the heat carrier brings the average temperature head closer to a maximum possible temperature head in accordance with the counterflow layout. This in turn allows the heat efficiency of the heat exchanger work to be upgraded.

Each opposite seal is expedient to be formed by a pair of parallel vertical partition walls of which one is to be rigidly joined with the inner surface of the housing and to be spaced from a housing side-wall, while the other vertical baffle member must be rigidly joined with the housing side-wall and be spaced from the inner surface of the container.

The provision of the opposite seals occupying a small area makes it possible to obtain a ratio between the container area and the housing area of 2:1 in the heat exchanger cross-section. With such a ratio is achieved an optimum (lower as against the prior art devices) velocity of the gaseous heat carrier within cavities defined by the inner surface of the container and the outer surface of the housing.

Due to such an arrangement, the non-uniformity of the motion of a heat carrier through the tubes is minimized, thereby resulting in improvement of the heat exchange between the heat carriers being directed through the tubes and between the tubes proper. Moreover, such kind of seals (i.e. labyrinth seals) provide for a required freedom of thermal expansions in the vertical direction under conditions of low values of transfers of the medium from one cavity (chamber) into another due to a pressure gradient of the heat carriers.

The distance between the adjacent tiers of tubes in the region of each horizontal baffle member is possible to be maintained at least twice the distance between the remaining tiers of tubes.

Owing to such an arrangement, the stability of the heat work of the heat exchanger is ensured under conditions of significant thermal expansions, and especially at high average temperature levels. It is achieved by the fact that a horizontal baffle member rigidly joined to the inner cavity of the container is shifted to a lower extent in the vertical direction as against an imaginary level on the housing. As a result, the amount of the heat carrier flowing through the tubes at any moment of operation of the heat exchanger remains constant for any other conditions. This in turn improves to some extent the heat work of the heat exchanger.

The upper and lower end walls are expedient to be rendered a convex shape, each side of the housing is to be rigidly joined with the inner surfaces of the upper and lower end walls.

Such a design of the heat exchanger is preferable under gauge pressures. In addition, such a shape of the end walls prevents ash stagnation.

It is expedient to place a temperature expansion joint between the container and the upper end wall, said joint being formed by at least two hollow discs.

Such a temperature expansion joint receives the forces caused by a considerable difference in thermal displacement under conditions of high gauge pressure and a temperature of the heat carrier of a predetermined density. Moreover, such a heat carrier does not prevent the supply of the same heat carrier into the chambers disposed above. As a result, owing to the temperature expansion joint, the performance reliability of the heat exchanger is upgraded, especially at a high pressure of gaseous heat carriers.

The supports of the heat exchanger are expedient to be located in the place of intersection between the housing and the lower tapered end wall.

Such an arrangement of the heat exchanger supports allows the metal content thereof to be reduced. This is achieved due to the fact that each support is mounted in the points of application of maximum vertical forces, namely in the corners of a rectangular housing which are the most difficult regions of the heat exchanger from the viewpoint of ash, and symmetrically relative to the vertical axis of the heat exchanger.

The supply of one type of the heat carrier can be also formed by four branch pipes divided vertically in pairs by a partition wall to prevent any deflections of heat carrier flow path.

The invention is further explained in more detail in terms of a description of a heat exchanger within a dense gravity layer with reference to the accompanying drawings, in which:

DESCRIPTION OF PREFERRED EMBODIMENTS

Figure 1:
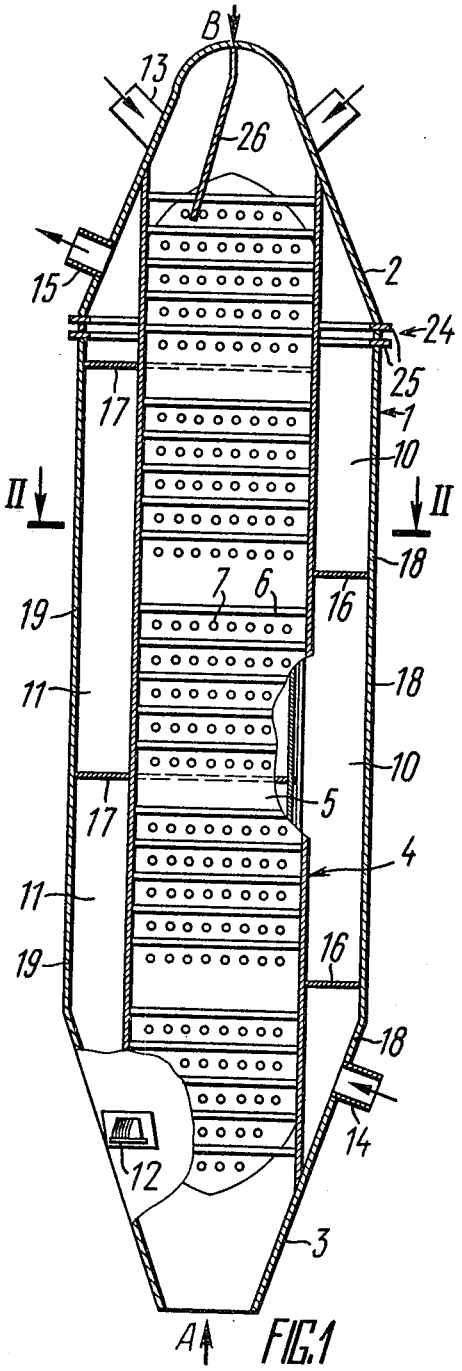
FIG. 1 shows schematically a vertical sectional view of a heat exchanger within a dense gravity layer, of the invention.
Figure 4:
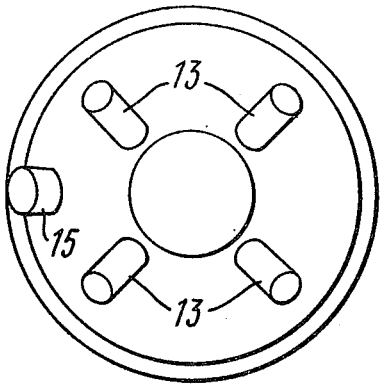
FIG. 4 is a view of FIG. 1 along the arrow B to illustrate branch pipes for supplying ash.

A heat exchanger within a dense gravity layer comprises a vertical cylindrical container 1 provided with upper and lower end walls 2 and 3.

A heating surface 4 is built into the container 1, said surface being formed by an elongated housing 5. The elongated housing 5 is a tube of a rectangular cross-section, formed by four walls. On the opposite walls of the housing 5 are provided coaxial openings (not shown) disposed in horizontal rows. Within the openings of the housing 5 are mounted tubes 6,7 extending from one wall to the opposite one. Each end of the tube 6,7 is rigidly fixed to a corresponding wall of the housing 5.

Between the inner surface of the wall of the container 1 and the periphery of the housing 5 are provided opposite seals 8,9. The seals 8,9 extend along the whole height of the container 1. Due to the presence of these seals 8,9 the inner cavity of the container 1 is divided along the height thereof into two portions 10,11.

The tubes 6,7 are mounted within the housing 5 in tiers. The tubes 6 of one tier are transverse relative to the tubes 7 of adjacent tiers.

The heat exchanger is mounted on supports 12. A branch pipe 13 is provided for supplying one type of the heat carrier, said branch pipe being disposed above the housing 5. To supply the other type of the heat carrier a branch pipe 14 is provided in the lower portion of the heat exchanger, said branch pipe communicating with a space defined by the surface of the housing 5 and the inner wall of the container 1. To discharge the same heat carrier, there is provided another similar branch pipe 15 which is disposed in the upper portion of the heat exchanger.

The cavities 10 and 11 communicate therebetween through the tubes 6,7 of the housing 5.

In accordance with the invention, the inner cavities 10,11 of the container 1 are divided vertically by horizontal baffle members 16,17.

Each horizontal baffle members 16,17 is rigidly fixed by one edge thereof to the inner surface of the container 1. With the other edges the horizontal baffle members 16,17 are adjoining the housing 5 in a spaced relation therewith. The baffle members 16 are disposed in chessboard pattern relative to the baffle members 17. Due to such an arrangement, chambers 18 formed as a result of dividing the cavities 10,11 by the horizontal baffle members, are also disposed relative to chambers 19 in chessboard pattern. In such a manner, repeated variation of the direction of movement of the heat carrier is ensured, said variation being described below.

According to the invention, the opposite seals are formed by pairs of vertical partition walls, respectively 20,21 and 22,23.

Figure 2:
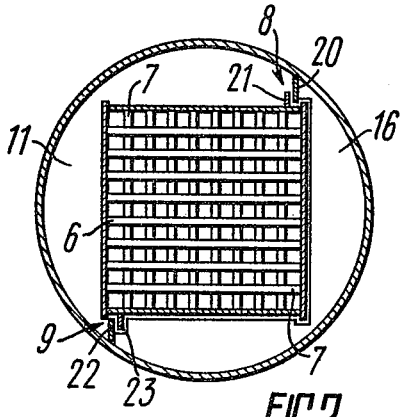
FIG. 2 is an enlarged cross-sectional view of FIG. 1 taken along the line II—II to illustrate mutual location of tubes, and baffle members and partition walls, the horizontal baffle member (nearest to the sectional line) being shaped for better perception.

The vertical partition walls 20 and 22 rigidly adjoin the inner surface of the container 1 and are spaced from the surface of the edges of the housing 5. The vertical partition walls 21 and 23 rigidly adjoin the edges of the housing 5 and are spaced from the inner surface of the container 1. Referring to FIG. 2, the vertical partition walls 20,22, and 21,23 are preferably of different width and are parallel to each other, a minimum possible space being provided therebetween. Such a design and arrangement of the vertical partition walls 20,22, and 21,23 create labyrinth seals.

Figure 3:
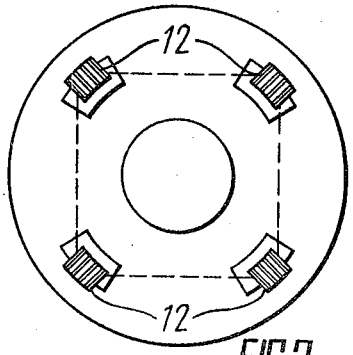
FIG. 3 is a view, taken along the arrow A in FIG. 1, of a lower portion of the heat exchanger to illustrate location of supports relative to the housing.

In accordance with a modification of the invention, the distance between adjacent tiers of the tubes 6,7 (FIG. 3) relative to each horizontal baffle member 16,17 is at least twice the distance between the remaining tiers. In other words, one tier of tubes is absent at the level of each horizontal baffle member, e.g. 6 or 7, and the level of this baffle member is closer to a tier disposed thereabove.

According to still another modification of the invention, the upper 2 and lower 3 end walls are of a convex shape. Referring to FIG. 1, the upper end wall 2 has the form of a truncated cone provided with a curvilinear apex. The lower end wall 3 is a truncated cone with a central opening.

The housing 5 is installed inside the container 1 so that each of its sides is conjugated and rigidly connected with the inner surfaces of each tapered end wall 2,3 along the line of intersection thereof.

The lower end wall 3 of the heat exchanger is supported by the support members 12.

In accordance with another modification of the invention, the location of the support members 12 corresponds to the intersection between the corners of the housing 5 and the lower tapered end wall 3.

In the upper portion of the heat exchanger, between the container 1 and the upper end wall 2 is provided a temperature expansion joint 24. The temperature expansion joint 24 is formed by at least two hollow discs 25. The hollow discs 25 are rigidly connected along the periphery thereof with the container 1 and the end wall 2 respectively, while in the central portion they loosely embrace the housing 5 thereby forming a conduit for the passage of the heat carrier.

The above described heat exchanger is designed for use in energy-technological lines for processing oil shales. Generally, these lines are provided with two stages of ash arresting. In turn, each stage comprises two cyclone separators, or devices for ash arresting. Thus, to ensure ash receipt by the heat exchanger, the latter is preferably provided with four branch pipes 13 for supplying ash. Due to the fact that a pressure difference can possibly occur within an energy-technological line at various stages of ash arresting, a baffle member 26 is mounted between the branch pipes 13 for supplying ash. The baffle member 26 serves to prevent the influence exerted by a flow of ash from one stage of the energy-technological line to another. The baffle member 26 rigidly adjoins the inner surface of the upper end wall 2 and may be inclined with respect to the vertical plane in order to equalize velocities of ash flows entering the heat exchanger.

The length of the baffle member 26 is sufficient to provide a resistance to the ash flow in the process of heat exchange, said ash being supplied from one stage, into the cavity of the end wall 2, whereto ash is directed from another stage of the energy-technological line, in the presence of a pressure difference between these flows of ash.

The above described heat exchanger operates as follows.

In the starting position, a heat carrier in the form of air is continuously supplied into the heat exchanger through the branch pipe 14 and is discharged therefrom through the branch pipe 15. The lower end of the housing 5 is closed. The inter-tube space of the housing 5 is filled with ash which has been fed from the energy-technological line for processing oil shale, so that the uppermost tier of tubes 6 or 7 is buried in ash.

When opening the lower end of the housing, ash flows downwardly under the action of its proper weight and gauge pressure, thereby creating a uniform velocity within the inter-tube space of the housing 5.

The heat carrier to be heated, being in the form of air, is supplied to the lower chamber 18. From the chamber 18 air is supplied to the chamber 19 through tubes 6 and 7. Following this, while moving from the chambers 19 into the chambers 18 and continuously changing the flow direction by 180°, air is lifted upwardly and heated to a predetermined temperature.

Ash, being a dense gravity layer, is shifted downwardly and in the course of contacting with the pipes 6 and 7 gives its heat to air flowing through the tubes.

What is claimed is:

1. A heat exchanger within a dense gravity layer, comprising:

a vertical cylindrical container provided with upper and lower end walls and forming a cavity therewith;

a heating surface mounted inside said container in spaced relation therewith and formed by a tubular housing opened at a lower end, said housing having a perforated surface, and a plurality of tubes mounted in tiers within said housing, said tubes being so disposed that the tubes of one tier are substantially transverse to the tubes of adjacent tiers;

opposite seals mounted between an inner surface of said container and the housing of said heating surface to vertically divide the cavity of said container into two portions;

an inlet for supplying a first heat carrier medium inside the housing of said heating surface, said inlet for supplying said first heat carrier medium being formed by a plurality of branch pipes and a baffle member substantially vertically and equally dividing said plurality of branch pipes, to prevent deflection of the flows of the first heat carrier medium;

a branch pipe for supplying a second heat carrier medium into a space between the inner surface of the container and the housing of said heating surface;

a branch pipe for discharging said second heat carrier medium from the space provided between the inner surface of the container and the housing of said heating surface;

a plurality of substantially horizontal baffle members mounted within the two portions of the cavity of said container in chessboard pattern relative to one another and dividing these portions of the cavity of said container into chambers disposed along the height in chessboard pattern to change the direction of flow of said second heat carrier medium; and a plurality of support members.

2. A heat exchanger as claimed in claim 1, characterized in that each of said opposite seals is formed by a pair of substantially parallel and vertical partition walls of which one rigidly adjoins the inner surface of said container and is spaced from a side of said housing, while the other substantially vertical partition wall rigidly adjoins the side of said housing and is spaced from the inner surface of said container, thus forming labyrinth seals.

3. A heat exchanger as claimed in claim 1, characterized in that in the region of each substantially horizontal baffle member, the distance between the adjacent tiers of tubes is at least twice the distance between the remaining tiers of tubes.

4. A heat exchanger as claimed in claim 1, characterized in that the upper and lower end walls of said container have a convex form, each side of said housing being conjugated and rigidly connected with the inner surfaces of the upper and lower end walls.

5. A heat exchanger as claimed in claims 1 or 4, characterized in that between said container and the upper end wall thereof, a temperature expansion joint formed by at least two hollow discs is provided.

6. A heat exchanger as claimed in claim 5, characterized in that said support members are located in the point of intersection between said housing and the lower tapered end wall.

7. A heat exchanger within a dense gravity layer, comprising:

a vertical cylindrical container provided with upper and lower end walls and forming a cavity therewith;

a heating surface mounted inside said container in spaced relation therewith and formed by a tubular housing opened at a lower end, said housing having a perforated surface, and a plurality of tubes mounted in tiers within said housing, said tubes being so disposed that the tubes of one tier are substantially transverse to the tubes of adjacent tiers;

opposite seals mounted between an inner surface of said container and the housing of said heating surface to vertically divide the cavity of said container into two portions, each of said opposite seals being formed by a pair of substantially parallel and vertical partition walls of which one rigidly adjoins the inner surface of said container and is spaced from a side of said housing, while the other substantially vertical partition wall rigidly adjoins the side of said housing and is spaced from the inner surface of said container, thus forming labyrinth seals;

an inlet for supplying a first heat carrier medium inside the housing of said heating surface;

a branch pipe for supplying a second heat carrier medium into a space between the inner surface of the container and the housing of said heating surface;

a branch pipe for discharging said second heat carrier medium from the space provided between the inner surface of the container and the housing of said heating surface;

a plurality of substantially horizontal baffle members mounted within the two portions of the cavity of said container in chessboard pattern relative to one another and dividing these portions of the cavity of said container into chambers disposed along the height in chessboard pattern to change the direction of flow of said second heat carrier medium; and a plurality of support members.

8. A heat exchanger as claimed in claim 7, characterized in that said inlet for supplying said first heat carrier medium is formed by four branch pipes and a baffle member substantially vertically dividing said four branch pipes into pairs, to prevent deflection of the flows of the first heat carrier medium.

9. A heat exchanger as claimed in claim 7, characterized in that in the region of each substantially horizontal baffle member, the distance between the adjacent tiers of tubes is at least twice the distance between the remaining tiers of tubes.

10. A heat exchanger as claimed in claim 7, characterized in that the upper and lower end walls of said container have a convex form, each side of said housing being conjugated and rigidly connected with the inner surface of the upper and lower end walls.

11. A heat exchanger as claimed in claims 7 or 10, characterized in that between said container and the upper wall thereof, a temperature expansion joint formed by at least two hollow discs, is provided.

12. A heat exchanger as claimed in claim 11, characterized in that said support members are located at the point of intersection between said housing and the lower tapered end wall.

13. A heat exchanger as claimed in claim 1, characterized in that said inlet for supplying said first heat carrier medium is formed by four branch pipes, with said baffle member substantially vertically dividing said four branch pipes into pairs.

14. A heat exchanger as claimed in claim 13 characterized in that said baffle member dividing said four branch pipes is inclined to equalize flow velocities of said first heat carrier medium through said four branch pipes into said heat exchanger.

* * * * *